US009622544B2

(12) United States Patent
Chen

(10) Patent No.: US 9,622,544 B2
(45) Date of Patent: Apr. 18, 2017

(54) ADJUSTING DEVICE FOR TIGHTENING OR LOOSENING LACE

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 0 days.

(21) Appl. No.: 15/187,765

(22) Filed: Jun. 20, 2016

(65) Prior Publication Data

US 2016/0286902 A1 Oct. 6, 2016

Related U.S. Application Data

(62) Division of application No. 14/585,153, filed on Dec. 29, 2014, now Pat. No. 9,408,438.

(30) Foreign Application Priority Data

Feb. 17, 2014 (TW) ..... 103105138 A

(51) Int. Cl.
*A43C 11/16* (2006.01)
*A43C 7/02* (2006.01)
*A43C 11/20* (2006.01)

(52) U.S. Cl.
CPC ..... *A43C 11/165* (2013.01); *A43C 7/02* (2013.01); *A43C 11/20* (2013.01); *Y10T 24/2183* (2015.01)

(58) Field of Classification Search
CPC ..... A43C 11/16; A43C 11/165; A45C 13/10; A61F 5/0018; A63C 10/06; A65H 75/4434; A65H 75/30; A41F 1/06; A41F 9/025; A45F 3/00; A45F 3/04; A45F 3/16; Y10T 24/37; Y10T 24/2187; Y10T 24/21; Y10T 24/2183
USPC ..... 2/417, 418; 242/385.4; 24/16 R, 20 TT, 24/68 B, 68 R, 68 SK, 115 R, 712, 712.1, 24/712.2, 712.9, 713.2, 715.3, 909, 712.5, 24/71.1, 132 R, 132 AA, 712.4, 712.6; 254/223, 238, 239; 36/50.1
See application file for complete search history.

(56) References Cited

U.S. PATENT DOCUMENTS 6,202,953 B1 * 3/2001 Hammerslag ..... A43C 1/00 242/396.1
7,174,575 B1 * 2/2007 Scherer ..... A42B 3/145 2/418
7,367,522 B2 * 5/2008 Chen ..... A43C 7/00 24/68 SK
7,954,204 B2 * 6/2011 Hammerslag ..... A43B 5/16 24/68 SK
8,235,321 B2 * 8/2012 Chen ..... A43C 7/00 24/68 SK
8,245,371 B2 * 8/2012 Chen ..... A43C 7/00 24/68 B (Continued)

*Primary Examiner* — Robert J Sandy
*Assistant Examiner* — Rowland Do
(74) *Attorney, Agent, or Firm* — CKC & Partners Co., Ltd.

(57) ABSTRACT

An adjusting device for tightening or loosening a lace is provided. The adjusting device includes a base, a knob and a releasing unit. The releasing unit is disposed in the base and the knob, and the knob is used for winding the lace. The releasing unit and the knob are pivotally disposed in an accommodating space. The releasing unit includes at least one elastic arm corresponding to an annular tooth in the knob. The releasing unit can be raised or lowered on the base. When the releasing unit is raised, the knob can be freely rotated; and when the releasing unit is lowered, the rotation of the knob is limited in a releasing direction.

5 Claims, 10 Drawing Sheets

(56) References Cited

U.S. PATENT DOCUMENTS

| | | | | |
|---|---|---|---|---|
| 8,308,098 | B2 * | 11/2012 | Chen | A43C 7/00 24/68 SK |
| 8,516,662 | B2 * | 8/2013 | Goodman | A43C 11/165 24/68 SK |
| 8,832,912 | B2 * | 9/2014 | Ha | A43C 11/165 24/68 B |
| 9,072,341 | B2 * | 7/2015 | Jungkind | A43C 11/165 |
| 9,101,181 | B2 * | 8/2015 | Soderberg | A43C 11/165 |
| 9,193,561 | B2 * | 11/2015 | Yan | B65H 75/406 |
| 2010/0101061 | A1 * | 4/2010 | Ha | A43B 3/0042 24/712.5 |
| 2010/0251524 | A1 * | 10/2010 | Chen | A43C 7/00 24/713.2 |
| 2012/0023717 | A1 * | 2/2012 | Chen | A43C 7/00 24/713.2 |
| 2014/0123449 | A1 * | 5/2014 | Soderberg | A43C 1/003 24/712.1 |
| 2016/0009524 | A1 * | 1/2016 | Grenet | B65H 75/4431 242/395 |

* cited by examiner

ADJUSTING DEVICE FOR TIGHTENING OR LOOSENING LACE

RELATED APPLICATIONS

The present application is a Divisional Application of the U.S. application Ser. No. 14/585,153, filed Dec. 29, 2014, which claims priority to Taiwan Application Ser. No. 103105138, filed Feb. 17, 2014, all of which are herein incorporated by reference.

BACKGROUND

Technical Field

The present disclosure relates to a lace-adjusting device. More particularly, the present disclosure relates to an adjusting device for tightening or loosening a lace.

Description of Related Art

Recently, for preventing a foot from injury caused by sliding in a shoe while walking or sporting, it is particularly focused on adjusting the tightness between the foot and the shoe. In the past, common methods by using such as a shoelace, an elastic ribbon, a zipper or a Velcro tape is used to achieve this purpose. However, the Velcro tape is easily contaminated with dusts and scraps, and is easily fatigued after being used several times, thus having poor practicality; the zipper has a small adjusting range and poor fixity, and the elastic ribbon easily becomes rigid after a long time use. Thus, in the market, a shoelace-type shoe is most popular.

However, for children who cannot tie a shoelace, the shoelace is often loosened due to poor tightening; and for elders with decayed physical strength, it often bothers them to crouch down to tie a shoelace. More importantly, in some vigorous sport occasions such as basketball, tennis, rock climbing and skateboarding, etc. once the shoelace is loosened or the remaining shoelace is too long, a foot is easily tripping on the shoelace when being moved, or the shoelace is easily caught by a foreign matter, thus causing dangers, which cause great threats to professional athletes.

In the market, there is a fastener structure with a function of tightening or loosening a shoelace (see Taiwan Patent Ser. No. 1374016). The fastener structure is popular because it can be applied on various products requiring to tighten a lace on a wearable product. Such conventional fastener structure utilizes a ring-type stopping member and an elastic member (i.e., elastic plate) to generate a uniform vertical jamming force.

By the uniform vertical jamming force, a rotation motion of a cap and a vertical motion can drive a wire-plate to tighten or loosen the shoelace.

However, in such fastener structure, the number of the components is large and the structure is very complicated. Moreover, the cost of the elastic member is high, and the elastic member is easily elastically fatigued after being used repeatedly. Furthermore, damages easily occur between the elastic member and the other components that are resisted by the elastic member. Thus, the operation fault and the failure rate will increase.

Another a shoelace tightener is also disclosed in Japan Patent Application no. JP1995-000208. In such shoelace tightener, an actuation member is used to collaborate with a spring for producing a uniform vertical jamming force, and the actuation member is used to control the jamming or releasing. By this way, a vertical motion of the actuation member can control a re-plate to tighten or loosen a shoelace. However, the number of the components is still large and the structure of the shoelace tightener is still very complicated. Similarly, the spring is easily elastically fatigued and damaged after being used repeatedly and thus the operation fault and the failure rate will increase.

SUMMARY

According to one aspect of the present disclosure, an adjusting device for tightening or loosening a lace is provided. The adjusting device includes a base, a knob and a releasing unit. The base has an accommodating space and at least one stopping member, wherein the accommodating space is communicated with an ambience through two holes. The knob is pivotally disposed in the accommodating space, and the knob includes an annular track corresponding to the two holes and a plurality of annular teeth. The releasing unit is assembled in the accommodating space and the knob for providing a raising or lowering operation. The releasing unit is disposed in the accommodating space and the knob, for providing a raising or lowering operation. The releasing unit includes at least one elastic arm, a first limiting portion, a second limiting portion and an intermittent sliding portion located between the first limiting portion and the second limiting portion. Wherein the intermittent sliding portion allows the stopping member to pass therethrough when a preliminary force is exerted; when the stopping member is positioned by the first limiting portion, the releasing unit is located in a first position and the elastic arm is engaged with one of the annular teeth; and when the stopping member is positioned by the second limiting portion, the releasing unit is located a second position and the elastic arm is separated from the annular teeth.

According to another aspect of the present disclosure, an adjusting device for tightening or loosening laces is provided. The adjusting device includes a base, a knob and a releasing unit. The base includes an accommodating space and at least one stopping member, wherein the accommodating space is communicated with an ambience through two holes. The knob is pivotally disposed in the accommodating space, and the knob includes an annular track corresponding to the two holes and a first assembling portion. The releasing unit is disposed in the accommodating space and located above the knob for providing a raising or lowering operation relative to the knob, the releasing unit includes a second assembling portion, a first limiting portion and a second limiting portion, wherein an intermittent sliding portion is disposed between the first inviting portion and the second limiting portion.

Wherein the intermittent sliding portion allows the stopping member to pass therethrough when a preliminary force is exerted; when the stopping member is positioned by the first limiting portion the releasing unit is located in a first position and the first assembling portion is linked up with the second assembling portion; and when the stopping member is positioned by the second limiting portion, the releasing unit is located in a second position and the first assembling portion is not linked up with the second assembling portion.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
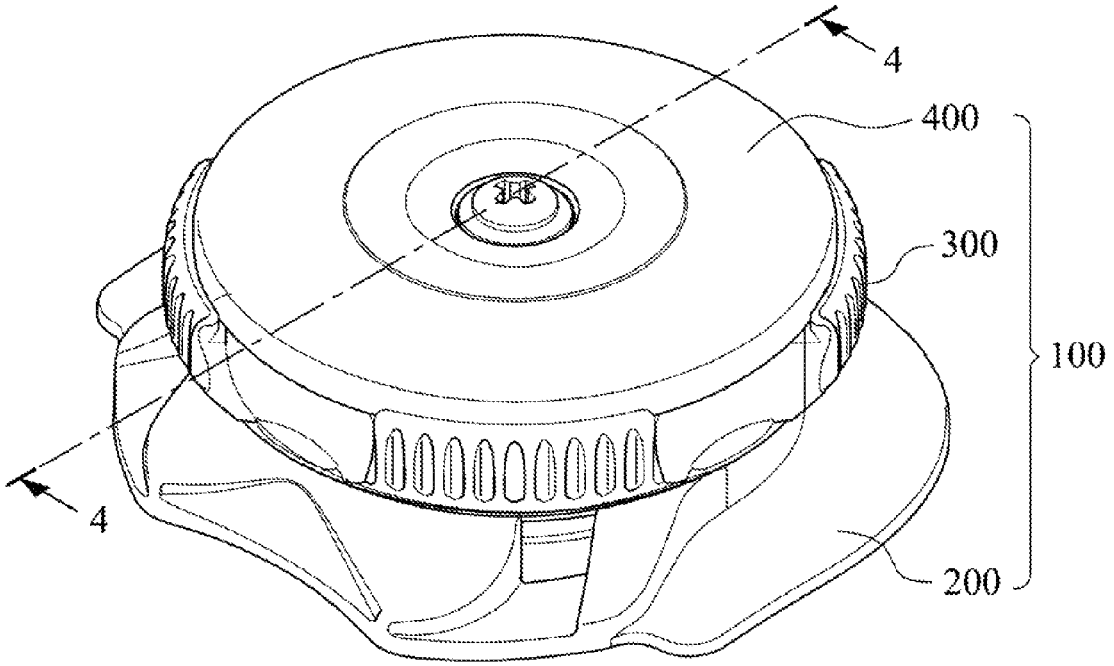
FIG. 1 is a perspective view showing an adjusting device according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

Figure 2:
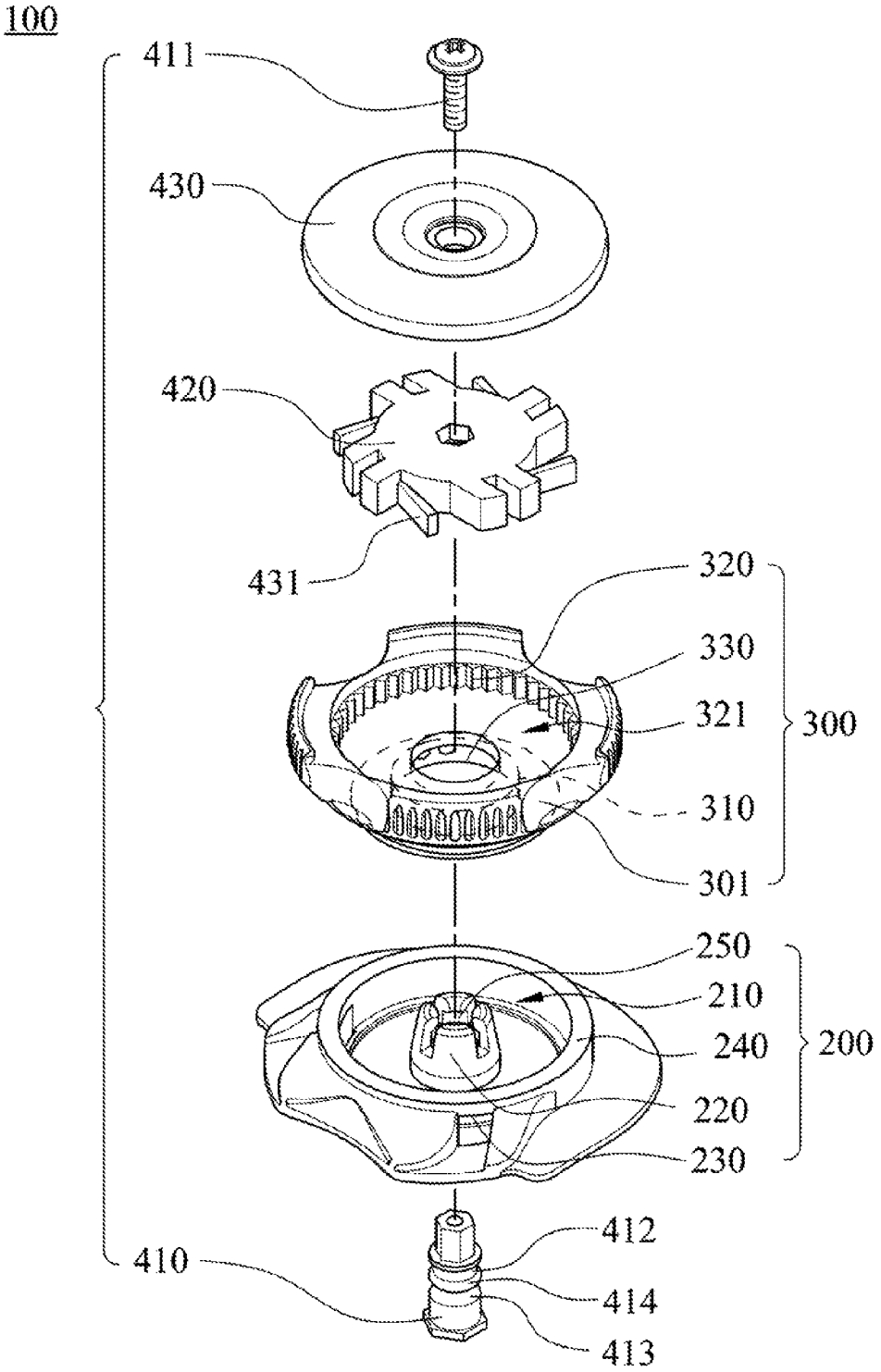
FIG. 2 is an exploded view showing the adjusting device of FIG. 1.
Figure 3:
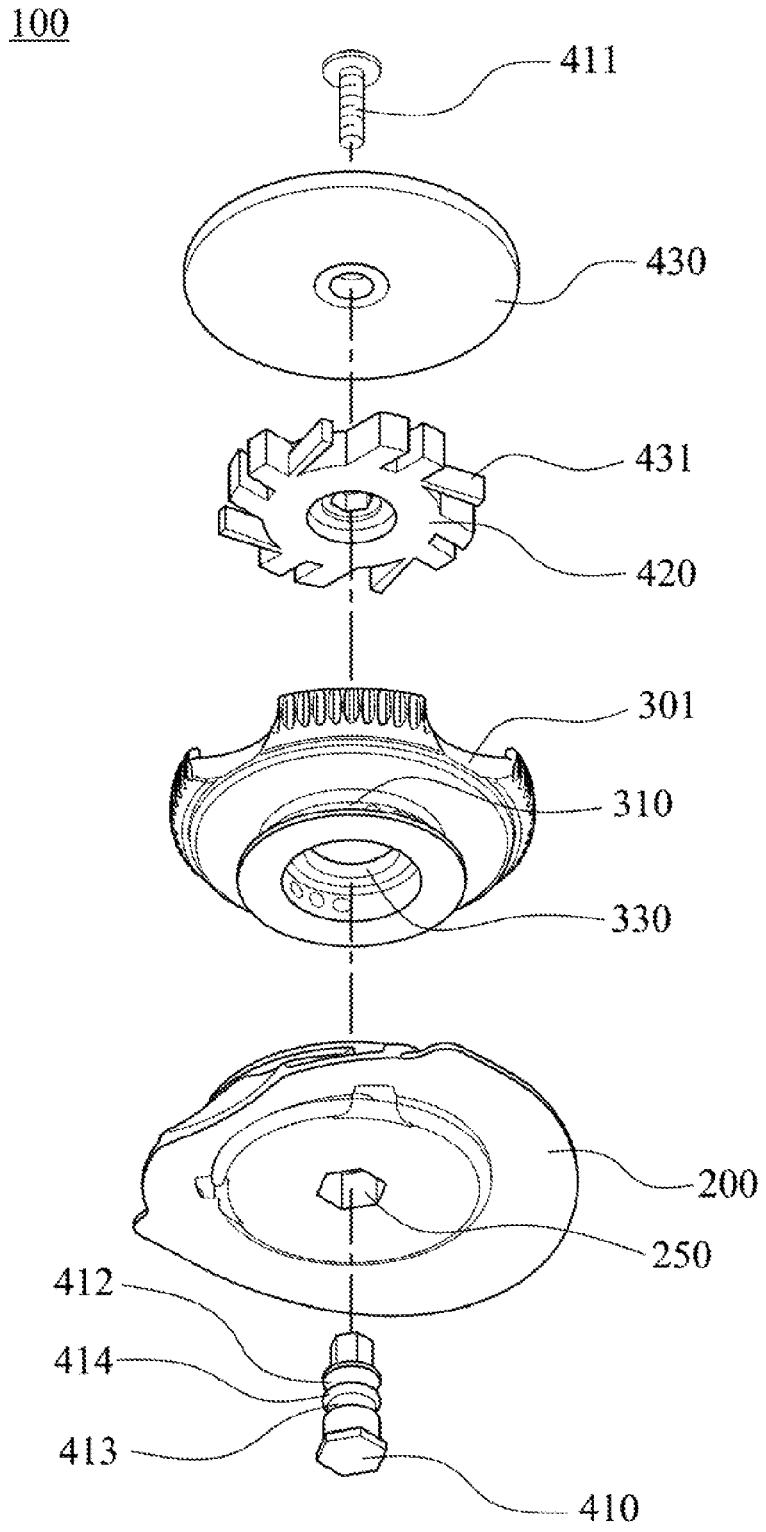
FIG. 3 is another exploded view showing the adjusting device of FIG. 1.
Figure 4:
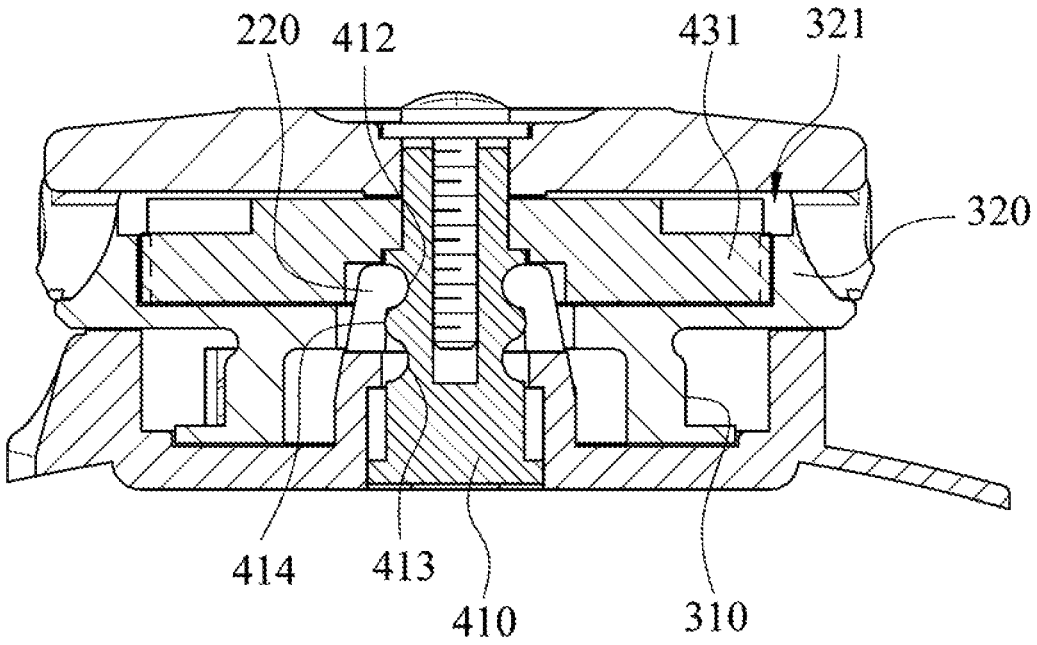
FIG. 4 is a cross-sectional view showing a releasing unit located in a first position of the adjusting device of FIG. 1.
Figure 5:
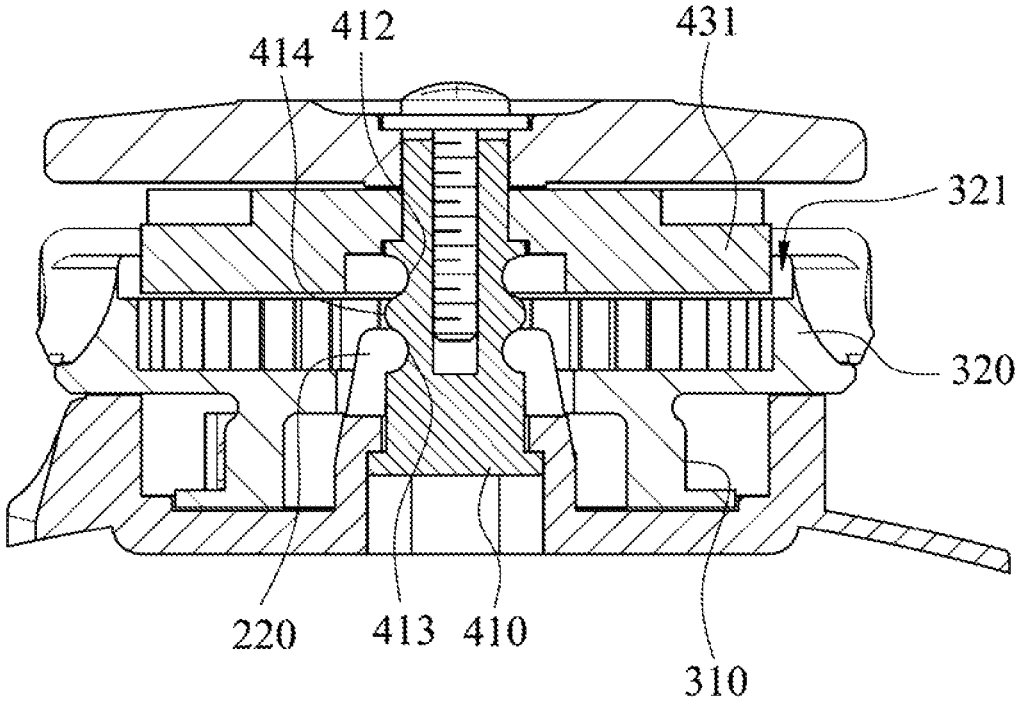
FIG. 5 is a cross-sectional view showing the releasing unit located in a second position of the adjusting device of FIG. 1.
Figure 6:
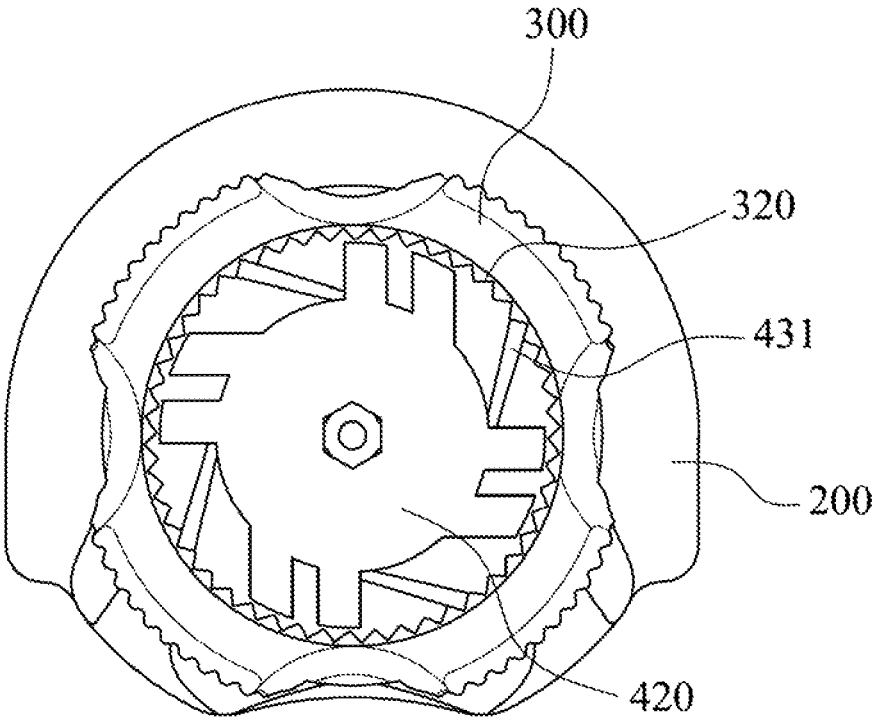
FIG. 6 is a schematic view showing an engaging status of an elastic arm according to one embodiment of the present disclosure.

FIG. 1 is a perspective view showing an adjusting device 100 according to one embodiment of the present disclosure; FIG. 2 is an exploded view showing the adjusting device 100 of FIG. 1; FIG. 3 is another exploded view showing the adjusting device 100 of FIG. 1; FIG. 4 is a cross-sectional view showing a releasing unit 400 located in a first position of the adjusting device 100 of FIG. 1; and FIG. 5 is a cross-sectional view showing the releasing unit 400 located in a second position of the adjusting device 100 of FIG. 1.

An adjusting device 100 for tightening or loosening a lace is provided in the present disclosure. The adjusting device 100 includes a base 200, a knob 300 and a releasing unit 400.

The base 200 includes an accommodating space 210 and at least one stopping member 220. The accommodating space 210 includes two holes 230, and the accommodating space 210 can be communicated with an ambience through the two holes 230. The base 200 has a circular wall 240 surrounding the accommodating space 210. The stopping member 220 includes a plurality of claws corresponding to a central axis of the base 200, and a through hole 250 is formed in a center of the stopping member 220.

The knob 300 is assembled above the accommodating space 210. A hole 330 is formed in a center of the knob 300, and an outer side of the knob 300 has grains for rotating by a user. The knob 300 includes an annular track 310 corresponding to the two holes 230 for winding a lace (not shown). The annular track 310 is located inside the circular wall 240. The knob 300 includes a plurality of annular teeth 320, and the annular teeth 320 are located above the circular wall 240. An engaging space 321 is formed between the annular teeth 320. Furthermore, four concave grooves 301 are formed on the outer side of the knob 300. The four concave grooves 301 are provided for allowing the user's finger to insert thereinto for operation.

The releasing unit 400 is disposed in the accommodating space 210 and the engaging space 321 of the knob 300. The releasing unit 400 is formed by sequentially assembling an axial member 410, an annular member 420 and a moving member 430 via a screw 411. A plurality of elastic arms 431 is surroundingly disposed on the annular member 420. The axial member 410 passes through the through hole 250, the hole 330, the annular member 420 and the moving member 430, and then is fastened by the screw 411. The axial member 410 includes a first limiting portion 412, a second limiting portion 413 and an intermittent sliding portion 414. The moving member 430 is located above and fully covers the engaging space 321. The moving member 430 is stacked on the knob 300, and the moving member 430 is corresponding to the knob 300 in shape. When a preliminary force is exerted, the intermittent sliding portion 414 allows the stopping member 220 to pass therethrough. When the stopping member 220 is positioned by the first limiting portion 412, the releasing unit 400 is located to a first portion, and the elastic arm 431 is engaged with one of the annular teeth 320, thus limiting a rotation of the knob 300 towards a releasing direction. When the stopping member 220 is positioned by the second limiting portion 413, the releasing unit 400 is located in a second position, and the elastic arm 431 is separated from the annular teeth 320, and thus the lace can be fully loosened by the knob 300. By using the aforementioned method, the elastic arm 431 can enter the engaging space 321 along an axial direction and can be engaged with the annular teeth 320 or separated from the annular teeth 320. A user may move the moving member 430 for raising or lowering the moving member 430 through the concave groove 301, thereby controlling the releasing unit 400 to be located in the first position or the second position. Therefore, the adjusting device 100 can tighten or loosen the lace without equipping with an elastic member that used in he conventional adjusting device, and is easily assembled and operated.

Figure 7:
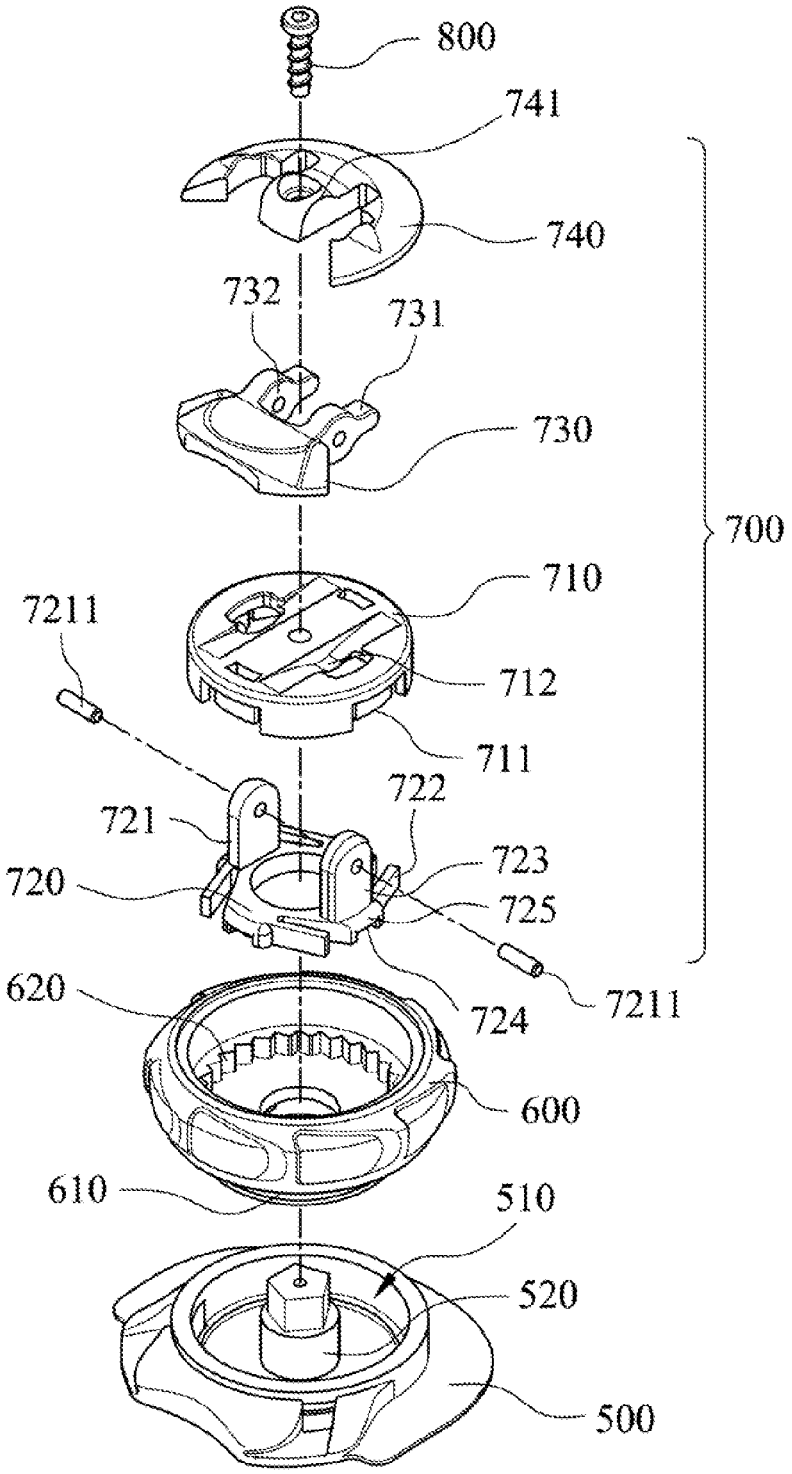
FIG. 7 is an exploded view showing an adjusting device according to another embodiment of the present disclosure.
Figure 8:
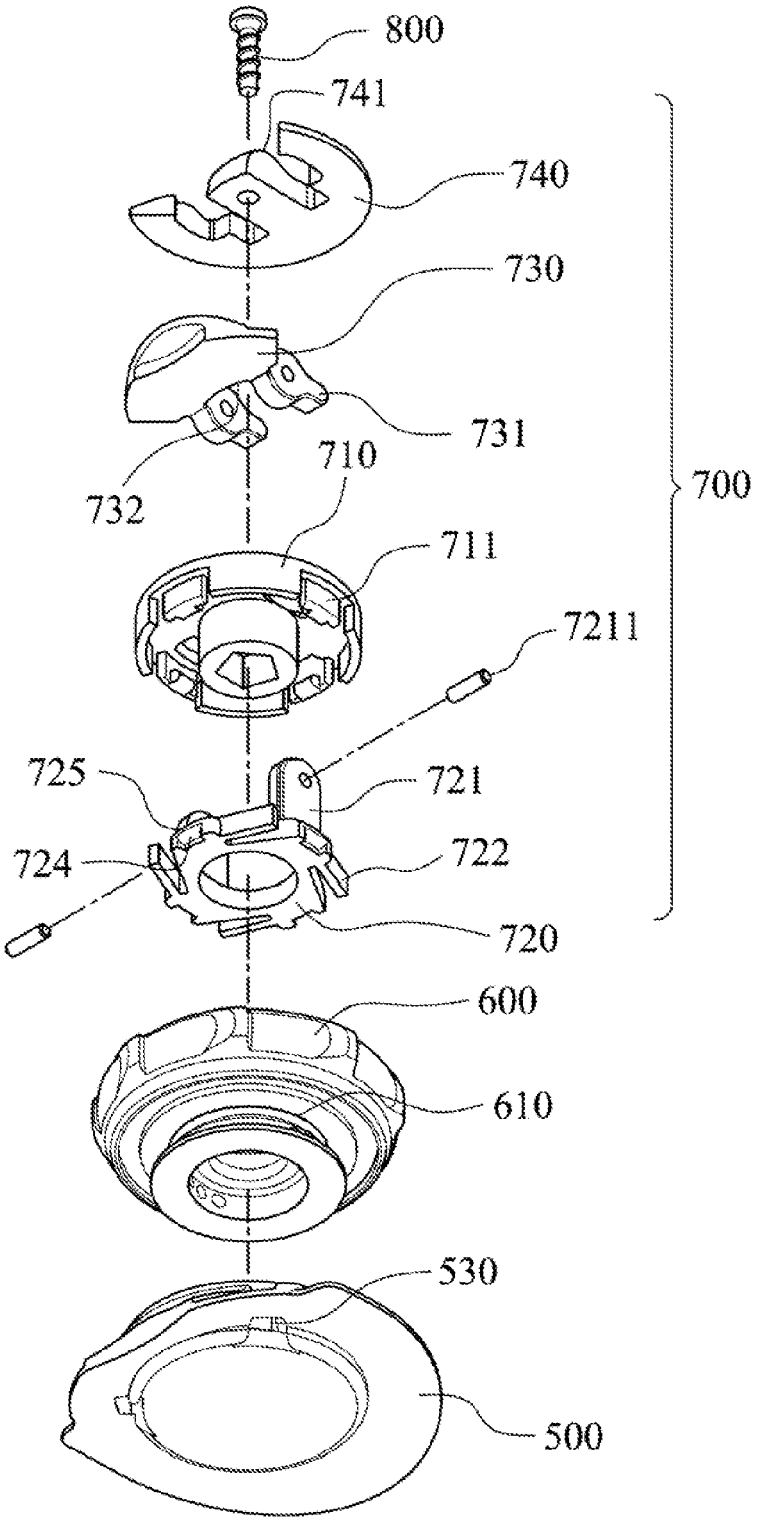
FIG. 8 is another exploded view showing the adjusting device of FIG. 7.
Figure 9:
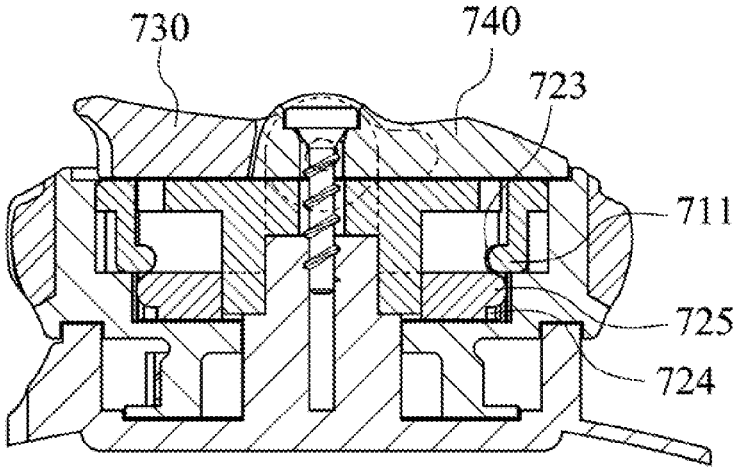
FIG. 9 is a cross-sectional view showing a releasing unit located in a first position of the adjusting device of FIG. 7.
Figure 10:
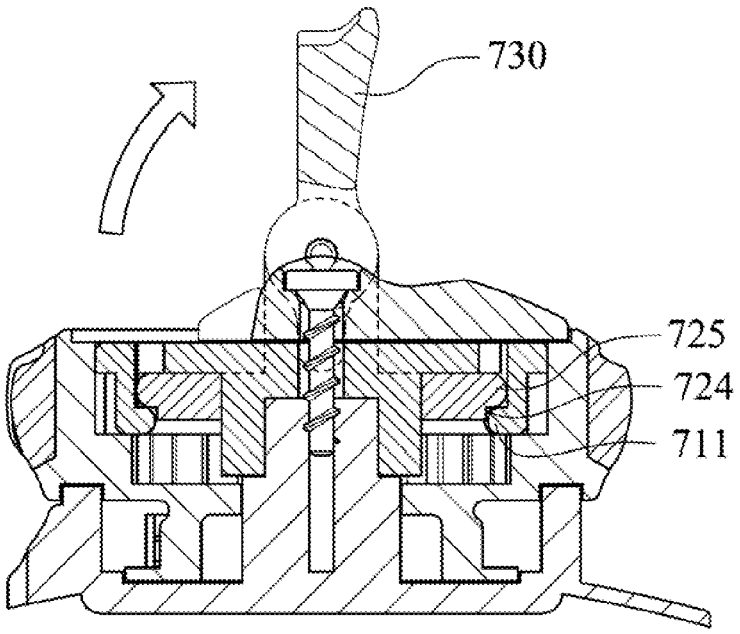
FIG. 10 is a cross-sectional view showing the releasing unit located in a second position of the adjusting device of FIG. 7.
Figure 11:
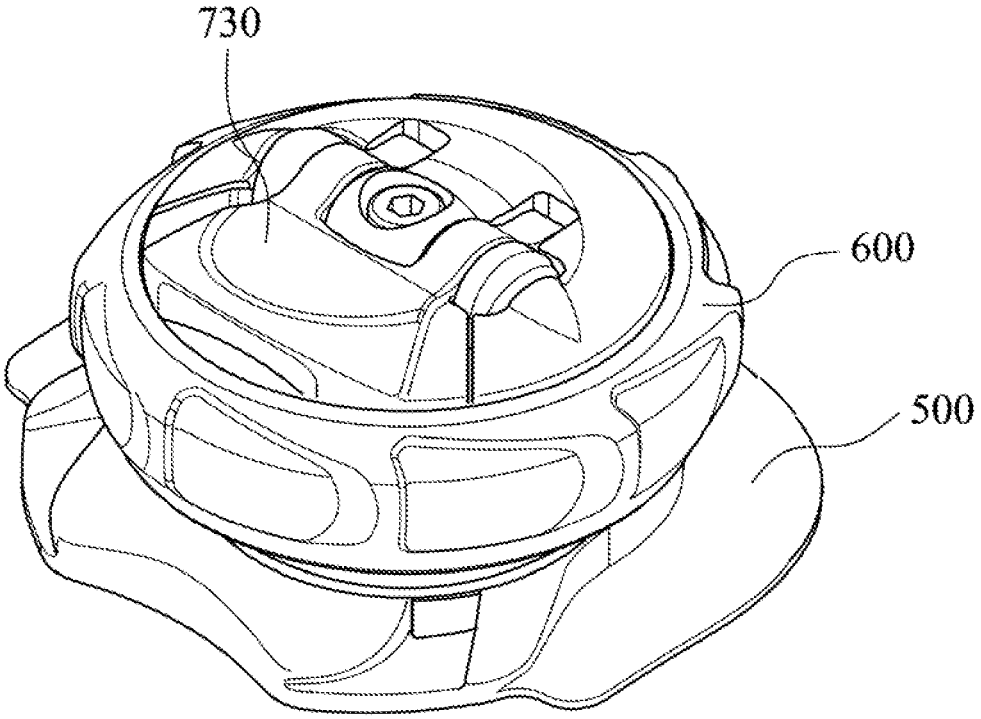
FIG. 11 is a perspective view showing the adjusting device of FIGS. 7.

FIG. 7 is n exploded view showing an adjusting device according to another embodiment of the present disclosure; FIG. 8 is another exploded view showing the adjusting device of FIG. 7; FIG. 9 is a cross-sectional view shoving a releasing unit 700 located in a first position of the adjusting device of FIG. 7; FIG. 10 is a cross-sectional view showing the releasing unit 700 located in a second position of the adjusting device of FIG. 7; and FIG. 11 is a perspective view showing the adjusting device of FIG. 7.

In the following embodiments, some components of the adjusting device are similar to those of the aforementioned embodiment, and are not described again herein.

The adjusting device includes a base 500 a knob 600 and releasing unit 700.

The base 500 includes an accommodating space 510. An axial member 520 is disposed in the center of the accommodating space 510, and the accommodating space 510 has two holes 530 that can be communicated with an ambience.

The knob 600 is pivotally disposed in the accommodating space 510 and can be rotated by a user's finger. The knob 600 includes an annular track 610 that is corresponding to the two holes 530 for winding a lace (not shown). The knob 600 includes a plurality of annular teeth 620.

The releasing unit 700 is assembled in the accommodating space 510 and the knob 600. The releasing unit 700 includes a stopping base 710, a moving member 720, a pulling arm 730 and a cover 740. The stopping base 710 is surrounded by a plurality of stopping members 711. The moving member 720 uses two pivot portions 721 to pass through the stopping base 710, and the pivot portions 721 are pivoted at one end of the pulling arm 730 by a pivot axis 7211 (the other end of the pulling arm 730 is used for operation by a user), and thus the pulling arm 730 is assembled on the stopping base 710. The pulling arm 730 includes a protruding portion 731 for resisting and pushing a supporting surface 712 of the stopping base 710. The protruding portion 731 of the pulling arm 730 pushes the supporting surface 712 to raise the moving member 720. The moving member 720 includes four elastic arms 722, four first limiting portions 723 and four second limiting portions 724. An intermittent sliding portion 725 is located between each of the first limiting portions 723 and each of the second limiting portions 724, While a preliminary force is exerted, the intermittent sliding portion 725 allows the stopping member 711 to pass therethrough. When the stopping member 711 is positioned by the first limiting portion 723, the releasing unit 700 is located in a first position, and each of the elastic arms 722 is engaged with the one of the annular teeth 620. When the stopping member 711 is positioned by the second limiting portion 724 (the protruding portion 731 of the pulling arm 730 pushes the supporting surface 712 to raise the moving member 720), the releasing unit 700 is located in a second position, and each of the elastic arms 722 is separated from the annular teeth 620. The cover 740 is fixed on the stopping base 710, and a bulge 741 is formed on the cover 740. The bulge 741 can be pushed by a surface 732 of the pulling arm 730, thereby assisting to raise the moving member 720.

Figure 12:
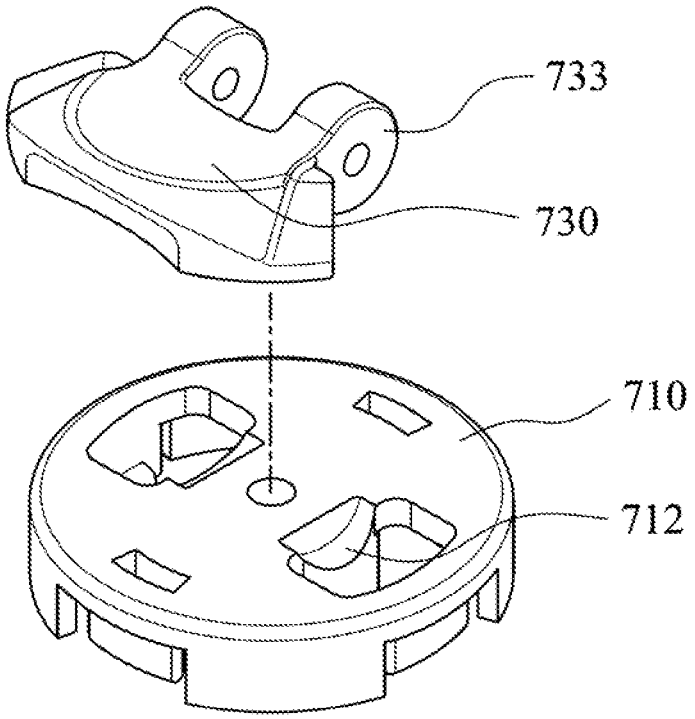
FIG. 12 is an exploded view showing another example of the adjusting device of FIG. 7.

A screw 800 passes through the stopping base 710, the moving member 720 and the cover 740 and is screwed to the axial member 520, FIG. 12 is an exploded view showing another example of the adjusting device of FIG. 7. In FIG. 12, the protruding portion 731 of the pulling arm 730 is replaced by an arc portion 733 for pushing the supporting surface 712 on the stopping base 710, thereby raising the moving member 720.

To sum up, the adjusting device of the present disclosure has a tightening or loosening function without equipping with an elastic member (e.g. the elastic plate or the spring used in the conventional adjusting device) and thus the failure rate and the damage caused by the repeating usage of the elastic member can be reduced. Moreover, in one embodiment of the present disclosure, the elastic arm 431 can freely enter the engaging space 321 and can be engaged with the annular teeth 320 or separated from the annular teeth 320. It should be mentioned that the aforementioned mechanism can include various variants, and therefore, generic terms such as "a first assembling portion" and "a second assembling portion" are used for descripting the aforementioned mechanism. For example, an axial combination of an elastic arm to annular teeth, an axial combination of annular teeth to annular teeth, a radial combination of annular teeth to annular teeth, a magnetic combination or a jamming combination can be possibly utilized. The details regarding the combination of the first assembling portion and the second assembling portion are similar to the aforementioned embodiments of the present disclosure, and are not repeated herein. Moreover, the adjusting device of the present disclosure can be applied to various products, such as shoes, clothes or other products that need to be tightened by laces.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An adjusting device for tightening or loosening a lace, the adjusting device comprising:

a base having an accommodating space and at least one stopping member, wherein the accommodating space is communicated with an ambience through two holes;

a knob pivotally disposed in the accommodating space, the knob comprising an annular track corresponding to the two holes and a plurality of annular teeth; and a releasing unit disposed in the accommodating space and the knob for providing a raising or lowering operation, the releasing unit comprising a plurality of elastic arms, an annular member, a first limiting portion, a second limiting portion and an intermittent sliding portion located between the first limiting portion and the second limiting portion, wherein one end of each of the elastic arms is connected to the annular member and the other end of each of the elastic arms is protruded outwards;

wherein the intermittent sliding portion allows the stopping member to pass therethrough when a preliminary force is exerted; when the stopping member is positioned by the first limiting portion, the releasing unit is located in a first position and the elastic arm is engaged with one of the annular teeth; and when the stopping member is positioned by the second limiting portion, the releasing unit is located in a second position and the elastic arm is separated from the annular teeth.

2. The adjusting device of claim 1, wherein the accommodating space is formed by a circular wall; the annular track is located inside the circular wall, and the annular teeth are located above the circular wall; an engaging space is formed between the annular teeth, and the elastic arm is allowed to enter the engaging space.

3. The adjusting device of claim 2, wherein the releasing unit is formed by sequentially assembling an axial member, the annular member and a moving member, wherein the annular member is surrounded by the elastic arms, wherein the first limiting portion, the second limiting portion and the intermittent sliding portion are located on the axial member, and the moving member is located above the engaging space.

4. The adjusting device of claim 3, wherein the moving member is corresponding to the knob in shape, and a concave groove is formed on the knob for allowing a user's finger to move the moving member.

5. The adjusting device of claim 2, wherein an inclined side is located on the annular teeth for guiding the elastic arms to enter the engaging space.

* * * * *